United States Patent [19]

Komarov et al.

[11] 4,037,628

[45] July 26, 1977

[54] TRAVELLING-WAVE LOOM

[76] Inventors: Jury Ivanovich Komarov, ulitsa Miklukho-Maklaya, 29, korpus 1, kv. 215; Dmitry Vladimirovich Titov, 13 Parkovaya ulitsa, 27, korpus 2, kv. 49; Gennady Ivanovich Kovalev, Kronshtadtsky bulvar, 27, kv. 85; Alexei Pimenovich Mshvenieradze, Amurskaya ulitsa, 22, korpus 2, kv. 78, all of Moscow, U.S.S.R.

[21] Appl. No.: 686,257

[22] Filed: May 13, 1976

[30] Foreign Application Priority Data

May 15, 1975 U.S.S.R. ..... 2134358

[51] Int. Cl.[2] ..... D03D 47/26

[52] U.S. Cl. ..... 139/436

[58] Field of Search ..... 139/436, 188, 190, 191, 139/196.3

[56] References Cited

U.S. PATENT DOCUMENTS

| | | | |
|---|---|---|---|
| 3,705,606 | 12/1972 | Stucki | 139/436 |
| 3,766,950 | 10/1973 | Vasek et al. | 139/436 |
| 3,863,680 | 2/1975 | Titou et al. | 139/436 |

*Primary Examiner*—Henry S. Jaudon

*Attorney, Agent, or Firm*—Steinberg & Blake

[57] ABSTRACT

A travelling-wave loom comprises a rotary reed. The rotary reed includes a shaft with disks angularly offset relative to one another and provided with teeth of different radial lengths. The disks are mounted on the shaft in groups of at least two disks. In one disk of each group, in the direction of the reed rotation, at least one of the teeth is located relative to the corresponding tooth of the other disk of each group so that a helical line formed by the front edges of these teeth is of a step-like shape. Such an arrangement of the disks and the teeth thereof creates favorable conditions both for reliable engagement of the weft and for advancing the latter to the fell of the cloth for subsequent beating-up.

6 Claims, 12 Drawing Figures

TRAVELLING-WAVE LOOM

The present invention relates to travelling-wave looms.

In the prior art, travelling-wave looms include a rotary reed with a shaft and disks secured on this shaft. The disks are provided, for instance, with at least three teeth of different radial lengths arranged in increasing order of length in the direction of the beating-up of the weft thread to the fell of the cloth. One of the teeth of the disk is the shortest one and serves as a means for propelling the weft thread carriers since it is adapted to cooperate with the butt end thereof, functioning at the same time as a carrier-engaging tooth. It engages the weft thread as soon as the latter emerges from the weft thread carriers.

The remaining teeth of the disks advance and force the weft threads to the fell of the cloth.

The disks are angularly offset on the shaft relative to one another whereby the crests of the teeth form parts of smooth helicoids.

However, in the course of operation of such a loom, a situation may develop when the weft thread, owing to the smoothness of the helicoids, slips over the crests of the teeth and fails to be engaged by the teeth of the disks, as a result of which the weft thread is not advanced to the fell of the cloth and a "trailing-in" occurs which diminishes the shed of the warp threads.

The weft thread carriers, upon having encountered such an entangled shed, are often unable to spread the warp threads apart for the shed of the normal size to be formed. This may damage the teeth of the reed disks contacting the weft thread carrier and break the warp threads.

The object of the present invention is to provide travelling-wave looms with such an arrangement of the rotary reed disks, which will make it possible for the teeth thereof to reliably engage both the weft threads to be advanced to the fell of the cloth and the threads which are likely to form a "trailing-in," whereby the quality of the produced cloth will be enhanced and the loom capacity stepped up.

This and other objects are attained in a travelling-wave loom, wherein a rotary reed has a shaft with disks installed thereon and provided with teeth of different radial lengths, these disks being angularly offset relative to one another so that the teeth thereof form parts of helicoids with one of the teeth serving to engage the weft thread as soon as it emerges from the weft thread carrier. In accordance with the present invention, the disks of the rotary reed are mounted on the shaft in groups including at least two disks with at least one of the teeth of one disk of each group located relative to the corresponding tooth of the other disk of each group so that a helical line formed by the front edges of these teeth is of a step-like shape.

Such an arrangement of the disks and the teeth thereof favors reliable engagement of the intertwined weft thread or any other thread intersecting the warp threads since due to the step-like shape of the helical line these threads manage to be in the way of the front edges of the step-forming teeth. The latter engage the thread and advance it to the fell of the cloth for subsequent beating up, thereby clearing the shed of the warp threads.

According to an alternative embodiment of the invention, the steps of the helical line are arranged relative to the axis of the shaft at an angle smaller than the angle of slope of the helical line with respect to the axis of the shaft.

According to another embodiment of the invention, the steps of the helical line are arranged parallel to the axis of the shaft and the front edge of one of the teeth of a disk of each group is in a plane parallel to the shaft axis and containing also the front edge of the corresponding tooth of the other disk of each group, whereby the step-like helical line is formed.

In accordance with the invention, one of the teeth of each disk, with the exception of the tooth engaging the weft thread carrier, has a pointed crest and the disks in each group are located relative to one another so that a predetermined space is formed between the pointed crests of the teeth of adjacent groups.

Due to the predetermined spaces being so formed, the weft thread or any other thread situated crosswise of the warp, while being acted upon by the warp threads, is urged against the crests of the teeth, falls into the pedetermined space and is advanced by the rotating disks to the fell of the cloth. In this way, reliable engagement of this thread and withdrawal thereof from the shed of the warp threads are accomplished.

In accordance with the invention, for the above predetermined spaces to be formed, the front edges of the teeth with the pointed crest in each group are in a common plane parallel to the shaft axis, the centre angle formed by the pointed crest of a tooth and by the top of the front edge of the carrier-engaging tooth of a disk of each group being smaller than the center angle between the corresponding teeth of the other disk of each group by the value of the angular offset of the disks relative to one another.

It can be seen that the herein disclosed cloth-forming mechanism makes it possible to reliably engage the weft thread or any other thread apt to form an entangled shed. Owing to this, timely clearing of the shed from the weft and other threads, as well as fluff, can be performed.

All this, taken together, precludes trapping of the weft thread carriers in the shed of the warp threads and breakage of the warp threads, whereby the dependability of operation of the cloth-forming mechanism is secured and, in the final analysis, the loom down or inoperative time is cut down.

Given below is a detailed description of the present invention with reference to the accompanying drawings; wherein.

Figure 1:
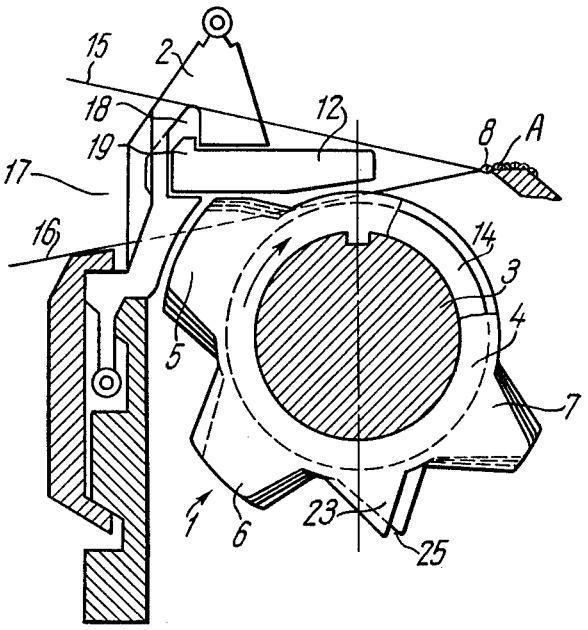
FIG. 1 is a cross-sectional view of a travelling-wave loom.

Referring now to the drawings, the mechanism (FIG. 1) of a travelling-wave loom is disposed between the apparatus for propelling the weft thread carriers outside the shed (not shown) and includes a rotary reed 1 and a separating grate 2.

The rotary reed 1 is formed by a shaft 3 and disks 4 secured on the shaft 3. Each of the disks 4 is provided with teeth 5, 6, 7 adapted to advance and force a weft thread A (FIG. 2) to a fell 8 of the cloth, the teeth having different radial lengths as is shown in FIG. 1.

The teeth 5, 6, 7 are arranged so that the radial lengths thereof increase in the direction of the beating-up of the weft thread A.

The disks 4 on the shaft 3 are angularly off set relative to one another so that the teeth 5 (FIG. 2) thereof form part of a helicoid 9, the teeth 6 form part of a helicoid 10, and the teeth 7 form part of a helicoid 11.

The tooth 5 (FIG. 1) of the disks 4 is the shortest one and serves as a means for propelling carriers 12 of the weft thread A while cooperating with a butt surface 13 (FIG. 2) thereof. Besides, this tooth 5 serves to engage the weft thread as soon as the latter emerges from the weft thread carriers 12.

Inserted between the disks 4 (FIG. 1) are rings 14 providing for gaps between the disks for warp threads 15 and 16, forming a shed 17 to pass therethrough.

The separating grate 2 is composed of plates and is intended for separating and distributing uniformly the warp threads 15 and 16 among the disks 4 of the reed in the process of formation of the shed 17 and also for guiding the carriers 12 of the weft thread flying through the shed.

The separating grate has a tunnel 18 wherein abutments 19 of the weft thread carriers 12 are partially accommodated.

Figure 3:
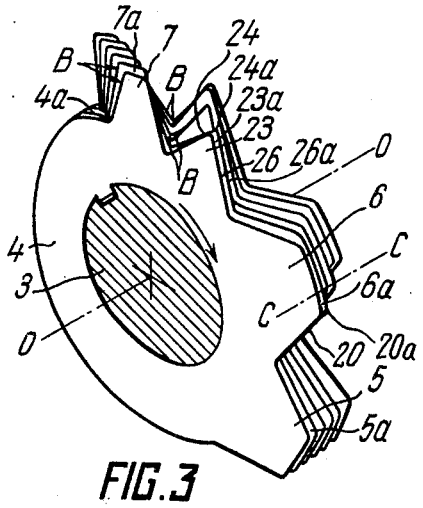
FIG. 3 is a perspective view of a part of the rotary reed.

The disks 4 of the rotary reed 1 are mounted on the shaft 3 in groups B (FIG. 3) including at least two disks 4 and 4*a*. In the embodiment of FIG. 3, there is shown a part of the reed including three groups B each of which groups includes two disks 4 and 4*a*, the teeth of the first disk 4 of the group B, in the direction of the reed rotation, being designated by numerals 5, 6 and 7 and the teeth of the second disk 4*a* of this group B, by numerals 5*a*, 6*a* and 7*a*. The first disk 4 of the group B is a preceding disk with respect to the second disk 4*a* of this group and the second disk 4*a* of the group is a subsequent disk of the group with respect to the first disk of this group.

Figure 2:
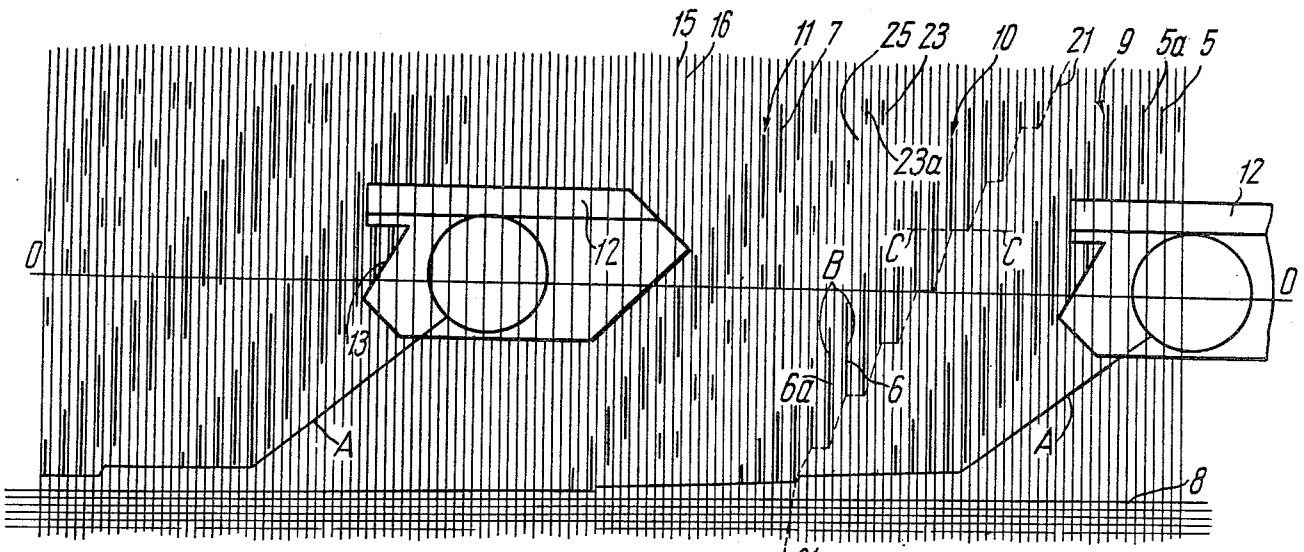
FIG. 2 shows the loom operation.

In each second disk 4*a* of the group one of the teeth, with the exception of the carrier-engaging tooth 5*a*, for instance, the tooth 6*a* is located relative to the corresponding tooth 6 of the first disk 4 of the same group so that a helical line 21 (FIG. 2) formed by front edges 20 and 20*a* of these teeth 6 and 6*a* has steps, the line 21 being shown in FIG. 2 as a broken line.

Figure 4:
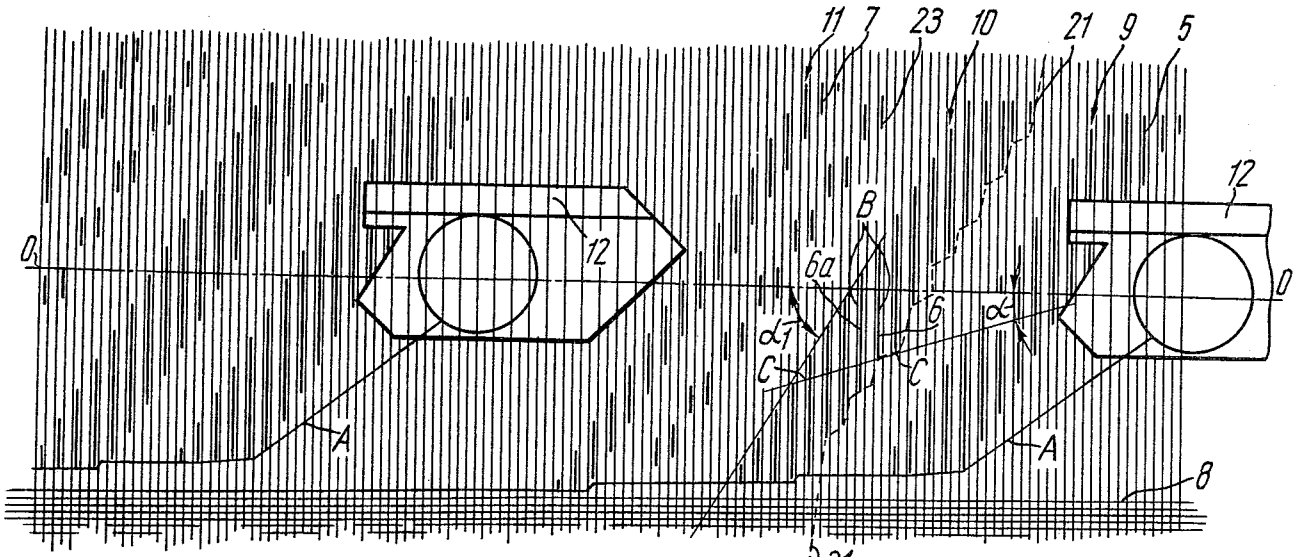
FIG. 4 shows another embodiment of loom operation.

Steps C—C of the helical line 21 are arranged parallel to an axis 0—0 of the shaft 3 (FIGS. 2 and 3). However, these steps C—C the line 21 may be arranged at angles $\alpha$ (FIG. 4) to the axis 0—0 of the shaft, this angle $\alpha$ being smaller than the angle of slope $\alpha_1$ of the helicoid 10, formed in part by the teeth 6 and 6*a*, with respect to the axis 0—0 of the shaft 3.

For the steps C—C (FIGS. 2 and 3) to be arranged parallel to the axis 0—0 of the shaft, the front edge 20*a* of the tooth 6*a* of the disk 4*a* in the group B is situated in a plane parallel to the shaft axis and also containing the front edge 20 of the tooth 6 of the disk 4 in the same group B as is shown in FIG. 3.

Figures 5, 6, 11, 12:
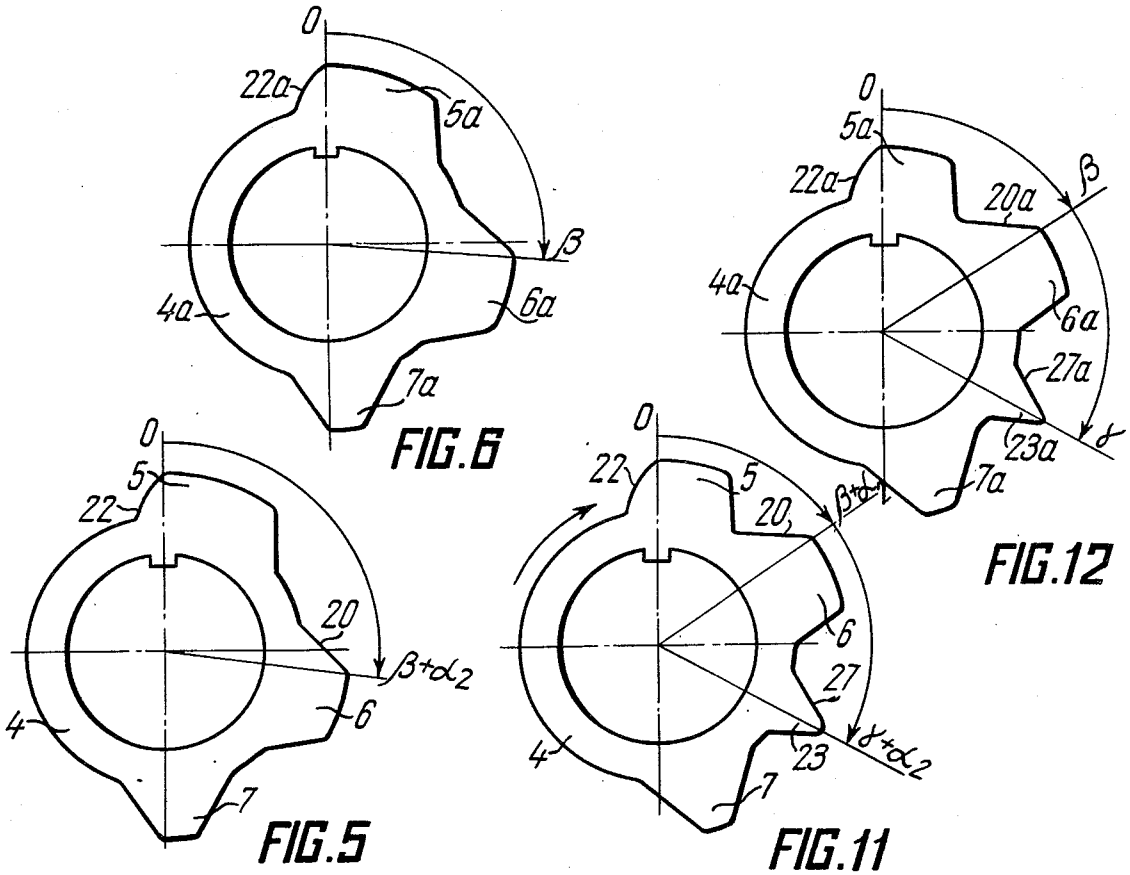
FIG. 5 shows the first disk of a group of disks of the rotary reed.
FIG. 6 shows the second disk of the group.
FIG. 11 shows another embodiment of the first disk of the group of disks of a rotary reed.
FIG. 12 shows the second disk forming a group with the disk of FIG. 11.

Inasmuch as the disks 4 in the rotary reed are angularly offset relative to one another by an angle $\alpha_2$ (FIG. 5) equal to $360°/n$, where $n$ is the number of disks per helicoid pitch, the teeth 6 and 6*a* of the disks 4 and 4*a* of the group B should be shifted relative to one another for the edges 20 and 20*a* to be made coplanar. Thus, in the disk 4 (FIG. 5) the center angle formed by the top of a front edge 22 of the carrier-engaging tooth 5 and the top of the front edge 20 of the tooth 6 is greater than a similar center angle $\beta$ of the disk 4*a* (FIG. 6) by the value of the angular offset of the disks 4 and 4*a* in the reed relative to one another and is equal to $\beta + \alpha_2$ (FIG. 5).

Figure 8:
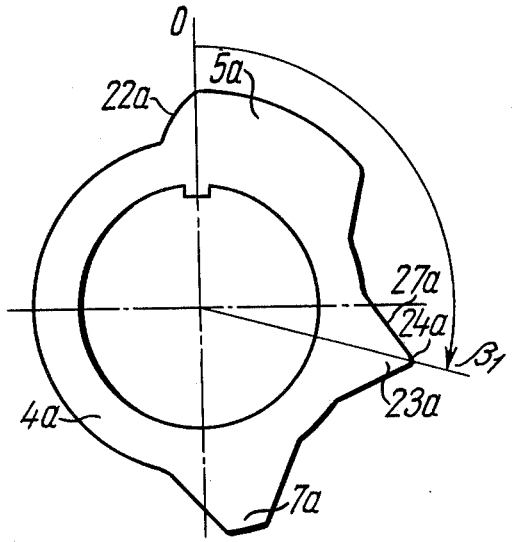
FIG. 8 shows another disk forming a group with the disk of FIG. 7.
Figure 7:
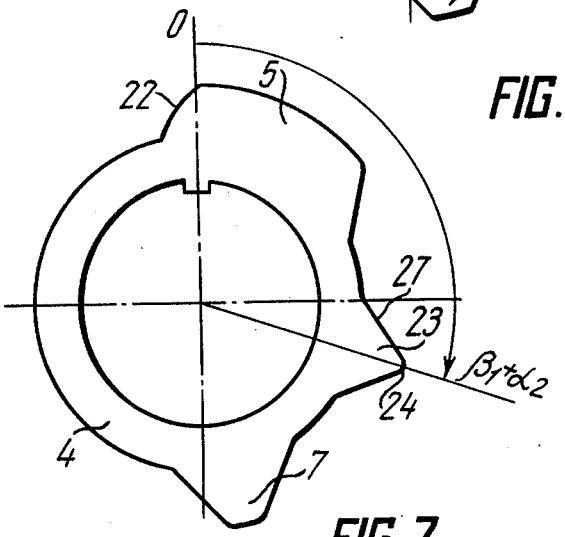
FIG. 7 shows an alternative embodiment of a disk of the rotary reed.

From FIGS. 7 and 8 it can be seen that in this embodimemt each of the disks 4 and 4*a* of the rotary reed has one tooth 23 and 23*a*, respectively, provided with a pointed crest 24 and 24*a*. It may be any tooth of the disk with the exception of the carrier-engaging tooth 5 and 5*a*, for instance, the tooth 6 and 6*a*. The teeth 5 and 5*a* of the disks 4 and 4*a* are shaped as is shown in FIGS. 7 and 8.

Figure 10:
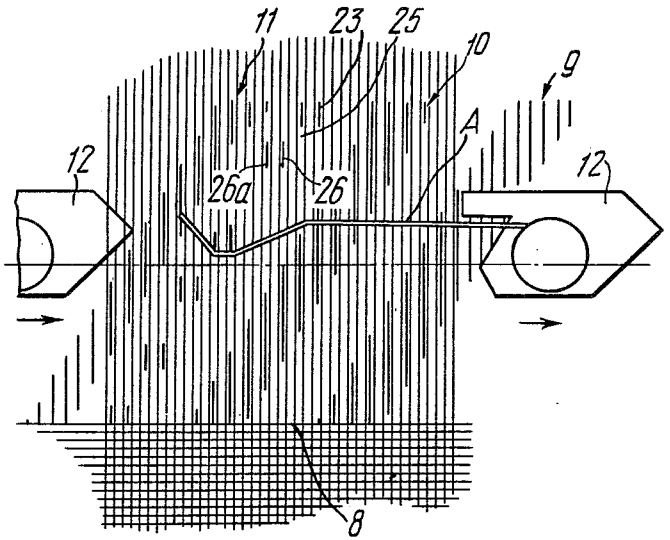
FIGS. 9 and 10 illustrate the process of withdrawal of intertwined thread from the shed of the warp threads.
Figure 9:
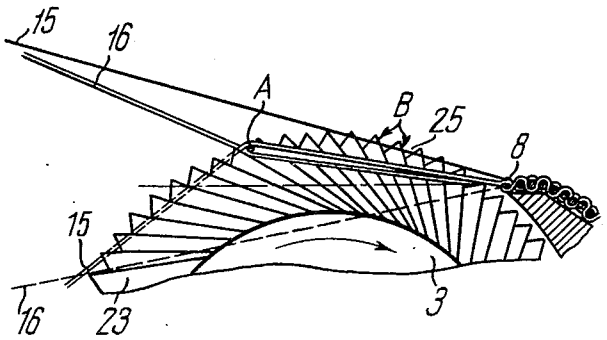

The disks 4 and 4*a* having the teeth 23 and 23*a*, respectively, in each group B are located relative to one another so that between the pointed crests of the teeth 23 and 23*a* of the adjacent groups B there is formed a predetermined space 25 (FIG. 9). These predetermined spaces 25 in the reed are also arranged in a helical line as is shown in FIG. 10.

In order to form the predetermined spaces 25 arranged in a helical line, front edges 26 (FIG. 3) and 26*a* of the teeth 23 and 23*a* of the disks 4 and 4*a* in each group B are made coplanar.

Thus, the center angle in the disk 4 of the group B (FIG. 7) formed by the top of the front edge 22 of the engaging tooth 5 and a pointed crest 24 of the tooth 23 is greater than a similar center angle $\beta_1$ (FIG. 8) of the disk 4*a* of this group B by a value of the angular offset of the disks 4 and 4*a* in the reed and is equal to $\beta_1 + \alpha_2$ (FIG. 7).

The disks 4 and 4*a* of the rotary reed, in addition to three teeth shown on FIGS. 5 to 8, may have four teeth as is shown in FIGS. 3, 11 and 12, that is, each of the disks 4 and 4*a* has the teeth 5, 6, 23, 7 and 5*a*, 6*a*, 23*a*, 7*a*, respectively.

Therewith, the teeth 23 and 23*a* of the disks 4 and 4*a* having the pointed crests 24 and 24*a*, in accordance with FIGS. 3, 11 and 12, are interposed between the teeth 6 and 7 of the disk 4 and the teeth 6*a* and 7*a* of the disk 4*a*.

The teeth 5 and 5*a* (FIG. 2), 7 and 7*a* of the disks 4 and 4*a* form helicoids 9 and 11, respectively, the front edges 20 and 20*a* of the teeth 6 and 6*a* form the helical line 21 having steps, and the pointed crests 24 and 24*a* of the teeth 23 and 23*a* of one group define with the corresponding pointed crests of adjoining groups the predetermined spaces 25.

The herein disclosed cloth-forming mechanism operates as follows.

The weft thread A (FIG. 2) is engaged by the teeth 5 and 5*a*, 6 and 6*a*, 7 and 7*a* of the disks of the reed, advanced and forced to the fell 8 of the cloth.

If the weft thread A fails to be engaged by the teeth 5 and 5*a* as shown in FIGS. 9 and 10, then, with the shed changed this thread remains in the shed, gets intertwined with the warp threads 15 and 16 (in FIG. 9 the warp threads 15 and 16 of the entangled shed are shown by double lines) and the entangled shed is a result.

With the reed disks rotating, the helical line 21 having the steps formed by the edges 20 and 20*a* of the teeth 6 and 6*a* as well as the predetermined spaces 25 formed by the pairs of pointed crests 24 and 24*a* of the teeth 23 and 23*a* of adjacent groups B upon having encountered the intertwined weft thread A placed crosswise the warp threads 15 and 16 engage it and advance to the fell of the cloth whereupon the weft thread is forced to the fell by the teeth 7 and 7*a* of the disks to be sequentially woven into the cloth. In such a way, both the trapping of the weft thread carriers and, consequently, the damage to the disks 4 and 4*a* of the reed and to the plates of the separating grate 2 are prevented.

The teeth 23 and 23*a* of the adjacent groups B of the disks forming the spaces 25 in the direction of rotation of the disks prove to be of great utility in the withdrawal of the entangled threads from the shed since these threads (FIG. 9) get into said spaces 25 and, with the disks rotating, are advanced to the fell of the cloth.

Moreover, front edges 26 and 26*a* (FIG. 10) of the teeth 23 and 23*a* contact the intertwined thread at two points as is shown in FIG. 10. This prevents disruption of the warp threads 15 and 16, thereby securing the reliable and timely withdrawal of the intertwined thread from the shed and, consequently, clearing the shed ahead of the next weft thread carrier 12.

Besides, the steps C—C of the helical line 21 exert an additional influence on the side of the weft thread which adds to more reliable engagement thereof.

What is claimed is:

1. In a travelling-wave loom having a plurality of weft thread carriers, a rotary shaft; disks fixed to said shaft for rotation therewith; said disks forming groups each including at least two disks, said disks having teeth of different radial lengths arranged in increasing order of radial length in the direction of rotation, said disk teeth having front edges and said disks being angularly offset relative to one another with said teeth thereof forming parts of helicoids, one of said teeth of each disk engaging the weft thread as soon as the latter emerges from the weft thread carriers, at least one of the teeth of a disk of each group being located relative to the corresponding tooth of the other disk of each group in such a way that a helical line formed by front edges of these teeth has steps.

2. The combination of claim 1, wherein the steps of the helical line are arranged at an angle to the axis of the shaft, which angle is smaller than the angle of slope, with respect to the axis of the shaft, of the helical line formed by the teeth of the disks.

3. The combination of claim 1, wherein the steps of the helical line are arranged parallel to the axis of the shaft.

4. The combination of claim 3, wherein, for forming the steps of the helical line, the front edges of a pair of corresponding teeth of the disks of each group are situated in a common plane parallel to the shaft axis.

5. The combination of claim 1, wherein one of the teeth of each disk has a pointed crest, and the disks in each group being located relative to one another for defining predetermined spaces between the pointed crests of the teeth of adjacent groups.

6. The combination of claim 5, wherein, for forming the predetermined spaces, the front edges of the teeth with the pointed crests in each group are made coplanar, the center angle formed by the pointed crest of one tooth of a disk and by the top of the front edge of another tooth of the latter disk of a given group being smaller than the center angle between the corresponding teeth of the other disk of said given group by the value of the angular offset of the disks of said given group relative to one another.

* * * * *